US008020484B2

(12) United States Patent
Eagleston

(10) Patent No.: US 8,020,484 B2
(45) Date of Patent: Sep. 20, 2011

(54) FIELD GUN TOW

(75) Inventor: David Andrew Eagleston, Barrow-in-Furness (GB)

(73) Assignee: BAE SYSTEMS plc, London (GB)

( * ) Notice: Subject to any disclaimer, the term of this patent is extended or adjusted under 35 U.S.C. 154(b) by 331 days.

(21) Appl. No.: 12/291,027

(22) Filed: Dec. 16, 2008

(65) Prior Publication Data

US 2010/0024635 A1 Feb. 4, 2010

(30) Foreign Application Priority Data

Dec. 18, 2007 (GB) ..... 0724687.9

(51) Int. Cl.
*F41F 1/06* (2006.01)

(52) U.S. Cl. ..... 89/40.02; 89/40.09; 89/40.15; 89/40.01

(58) Field of Classification Search ..... 89/40.01, 89/40.02, 40.08, 40.12, 40.13, 40.15, 40.09
See application file for complete search history.

(56) References Cited

U.S. PATENT DOCUMENTS

| | | | | |
|---|---|---|---|---|
| 1,167,673 | A * | 1/1916 | Bourdelles | 89/40.01 |
| 1,403,818 | A * | 1/1922 | Stock | 89/40.01 |
| 1,713,190 | A | 5/1929 | Methlin | |
| 1,896,911 | A * | 2/1933 | Methlin | 89/40.11 |
| 2,016,717 | A * | 10/1935 | Herlach | 89/40.11 |
| 2,049,420 | A | 8/1936 | Barnes | |
| 3,009,395 | A * | 11/1961 | Brandt | 89/40.01 |
| 3,315,566 | A | 4/1967 | Klapdohr et al. | |
| 3,910,157 | A * | 10/1975 | Johnsson et al. | 89/40.01 |
| 6,024,007 | A | 2/2000 | Searle et al. | |

FOREIGN PATENT DOCUMENTS

| | | |
|---|---|---|
| CH | 216979 | 1/1942 |
| GB | 04027 A | 4/1912 |
| GB | 499 582 | 1/1939 |
| GB | 2 313178 A | 11/1997 |
| WO | WO 2007/128272 A1 | 11/2007 |

OTHER PUBLICATIONS

Combined Search and Examination Report dated Mar. 4, 2009.
"105 MM Light Gun", International Defence Equipment Catalogue 1988/89, Dec. 31, 1988, Jules Perel's Pub. CO., vol. 2, pp. 88-89, XP002572932.
International Search Report and Written Opinion dated Mar. 25, 2010.

* cited by examiner

*Primary Examiner* — Gabriel Klein
(74) *Attorney, Agent, or Firm* — Scully, Scott, Murphy & Presser, PC

(57) ABSTRACT

A towed howitzer interchangeable between a travelling mode and a firing mode, the towed howitzer being suitable for deployment on a ground plane, the towed howitzer includes: a barrel for firing a projectile, the barrel defining a barrel axis, a cradle for holding the barrel at an azimuth and an elevation, a mechanism for varying the elevation and the azimuth of the barrel and a front leg for supporting an aiming mechanism. The front leg includes a wheel intended for contacting the ground at a foremost ground contact point; a suspension mechanism for resiliently mounting the wheel and a restraining mechanism for selectively enabling the suspension. The howitzer includes a back leg for contacting the ground at a backmost ground contact point. The back leg includes a hinging for swinging the back leg out of contact with the round.

9 Claims, 10 Drawing Sheets

FIELD GUN TOW

The following invention relates to a towed howitzer and in particular to a towed howitzer that is interchangeable between a travelling mode and a firing mode.

Howitzers may be towed or self-propelled. A towed howitzer will typically be configurable between a firing mode and a travelling mode.

In the firing mode, a towed howitzer will be configured to contact the ground over an area large enough such that moments associated with weight and firing forces can be opposed to prevent tipping. The points of contact between the howitzer and the ground tend to attach the howitzer to the ground at a particular location. For example, trail legs may be provided with spades that secure the howitzer because they dig into the ground.

In the travelling mode, the points of contact between the howitzer and the ground should allow the howitzer to move over the ground with as little friction as is practical. This reduces the load on the towing vehicle. Typically, when in the travelling position, the howitzer will rest on a set of wheels which allow the howitzer to be towed.

GB2313178 discloses a towed howitzer. In the firing position, the howitzer has front and back trail legs and a swivel platform all of which contact the ground. The front and back legs form points of contact with the ground that are peripheral to the swivel platform's points of contact.

So that the towed howitzer of GB2313178 may switch to a travelling mode, it is further provided with wheels that can be lowered onto the ground by hydraulic means. These wheels may be lowered when the howitzer is supported. The howitzer may be supported by, for example, the operating crew holding the barrel at the muzzle end. The front and back trail legs are hinged such that once the wheels support the howitzer, the legs can be lifted off the ground to a position generally above the swivel platform.

With the wheels so deployed and the front and back legs lifted off the ground, the howitzer is in the travelling position.

However, it is desirable to be able to switch between the firing mode and the travelling mode in as short a time as possible and using as little man power as possible. The lowering of the wheel is a particularly time consuming process.

It is therefore an object of the present invention to provide a howitzer which may be configured between a firing mode and a travelling mode in a short time and with as little operating crew as possible.

Accordingly there is provided a towed howitzer interchangeable between a travelling mode and a firing mode, the towed howitzer being suitable for deployment on a ground plane, the towed howitzer comprising: a barrel for firing a projectile, the barrel defining a barrel axis; a cradle for holding the barrel at an azimuth and an elevation; a means for varying the elevation and the azimuth of the barrel; a front leg for supporting the aiming means comprising a wheel intended for contacting the ground at a foremost ground contact point; a suspension mechanism for resiliently mounting the wheel; a restraining means for selectively enabling the suspension; a back leg for contacting the ground at a backmost ground contact point; and the back leg comprising a hinging for swinging the back leg out of contact with the ground, wherein in the firing mode, the roller suspension is locked and the back leg contacts the ground at the backmost contact point, and in the travelling mode, the back leg is lifted off the backmost contact point and the wheel suspension is applied.

Advantageously, this provides an apparatus that can quickly be converted between a firing and travelling mode because in both modes, the wheels contact the ground. Further, because the wheels are the front most ground contacting part of the howitzer base and also react against the firing forces, they take on the role of known front legs. This has the effect of doing away with the need for front legs which are provided solely to oppose firing forces. In turn this simplifies the conversion procedure because only the back leg (or back legs) needs to be swung over.

Preferably, the hinging articulates the back leg such that the back leg can rest over the cradle.

This beneficially allows the howitzer to fold up to form a compact unit when in the travelling mode.

Preferably, the hinging comprises a first hinge defining a first hinge axis, and a second hinge defining a second hinge axis, wherein the first hinge axis and the second hinge axis are generally perpendicular.

Advantageously this hinging arrangement gives the back leg two degrees of freedom and so can swing out wide so as to provide a wide base in the firing mode but can also swing back in to form a compact unit when in the travelling mode.

Preferably, the back leg has an elongate form defining a back leg axis, the first hinge axis being offset from the back leg axis towards the centerline of the howitzer, the first hinge thereby determining the inclination of the back leg to the centerline.

Offsetting the first hinge towards the centerline means that the operator need only swing the back leg over the azimuth centerline and then flip it over about the second hinge to stow the back leg over the cradle. This advantageously is a quick and simple operation which allows the crew to deploy or undeploy the howitzer with reduced effort.

Preferably the aiming means comprises a mortise and the back leg comprises a tenon, the tenon being situated generally at the same point on the back leg axis as the first hinge and being laterally offset from the back leg axis away from the centerline of the howitzer such that when the back leg is at a maximum inclination to the centerline, the tenon engages the mortise to secure the back leg.

Advantageously, this provides a robust way of securing the back leg in place in anticipation of the high forces that it must withstand during firing.

Preferably the barrel comprises a muzzle, the muzzle having a lug for forming an attachment to a towing pintle.

The provision of the muzzle lug not only saves time in binding the howitzer to the vehicle but also means that if a howitzer is in the firing state, the muzzle lug can be used to facilitate the conversion to the travelling mode. This facilitation is done by lowering the elevation of the barrel, connecting the muzzle lug to the towing pintle of the towing vehicle in which state the vehicle can drive forward a small amount to disengage the back legs from their ground contact point whereupon the back legs can be flipped over into the travelling position.

Preferably the wheel suspension comprises a wheel arm, connecting the wheel to the front leg, and pivotable about a resilient mount; a recess within the wheel arm; and wherein the suspension restraining means comprises a tongue for engaging the recess so as to inhibit pivoting of the wheel arm about the resilient mount.

Advantageously this can provide a robust mechanism for selectively engaging the suspension. This is necessary to withstand the forces experienced during firing.

Preferably the wheel arm is resiliently mounted on a sliding arm such that when the sliding arm is extended, the tongue engages the recess and such that when the sliding arm is retracted the tongue is disengaged from the recess.

Advantageously, this provides an apparatus that can easily be converted from travelling mode to firing mode because a single operation (i.e. extending the sliding arm) simultaneously locks out the suspension and extends the ground contact area. This gives rise to a stable firing platform in a short time and by way of a simple operation. Conversely, if the howitzer is in the firing position, the retraction of the sliding arm applies the suspension to quickly prepare the howitzer for travel.

According to another aspect of the invention there is provided a method of converting a towed howitzer from a travelling position to a firing position, the towed howitzer comprising: a barrel for firing a projectile, the barrel defining a barrel axis; a cradle for holding the barrel at an azimuth and an elevation; a recoil accommodating mechanism such that the barrel can move along the barrel axis relative to the cradle; an aiming mechanism means for varying the elevation and the azimuth of the barrel; a front leg for supporting the aiming mechanism comprising a wheel intended for contacting the ground at a foremost ground contact point; a suspension system for resiliently mounting the wheel; a suspension restraining mechanism; a back leg for contacting the ground at a backmost ground contact point, the back leg comprising a hinging for swinging the back leg out of contact with the ground, wherein the method comprises the steps of: swinging the back leg about the hinging so as to move the back leg from a resting position over the cradle to a position where the back leg contacts the ground at the backmost contact point; and applying the suspension restraining mechanism.

Advantageously, this method obviates the time consuming steps in the prior art where, when transferring from a firing to a travelling mode, wheels had to be lowered and front legs had to be flipped over. By removing the need for these stages, the present invention will tend to be converted between states in less time and/or using less man power.

According to another aspect of the invention, there is provided a howitzer comprising: a wheel axle means whereupon a first wheel and a second wheel are mounted, the first and second wheels being for contacting the ground at a first foremost point and a second foremost point; at least two back legs for contacting the ground at backmost contact points, wherein the wheel axle means is selectively rotatable about a pivot axle extending from a brace on the howitzer such that both the first wheel and the second wheel can contact the ground over a range of inclines lateral to the howitzer.

Advantageously, such a howitzer is able to support itself off of four ground contact points regardless of the topography of the ground from which it should be fired. Having both wheels contacting the ground gives a stable firing base which maintains the accuracy of the gun, distributes stresses more evenly about the howitzer structure and improves stability so as to reduce the possibility of the howitzer tipping over.

An exemplary embodiment of the invention now will be described with reference to the following figures, of which:

Figure 1:
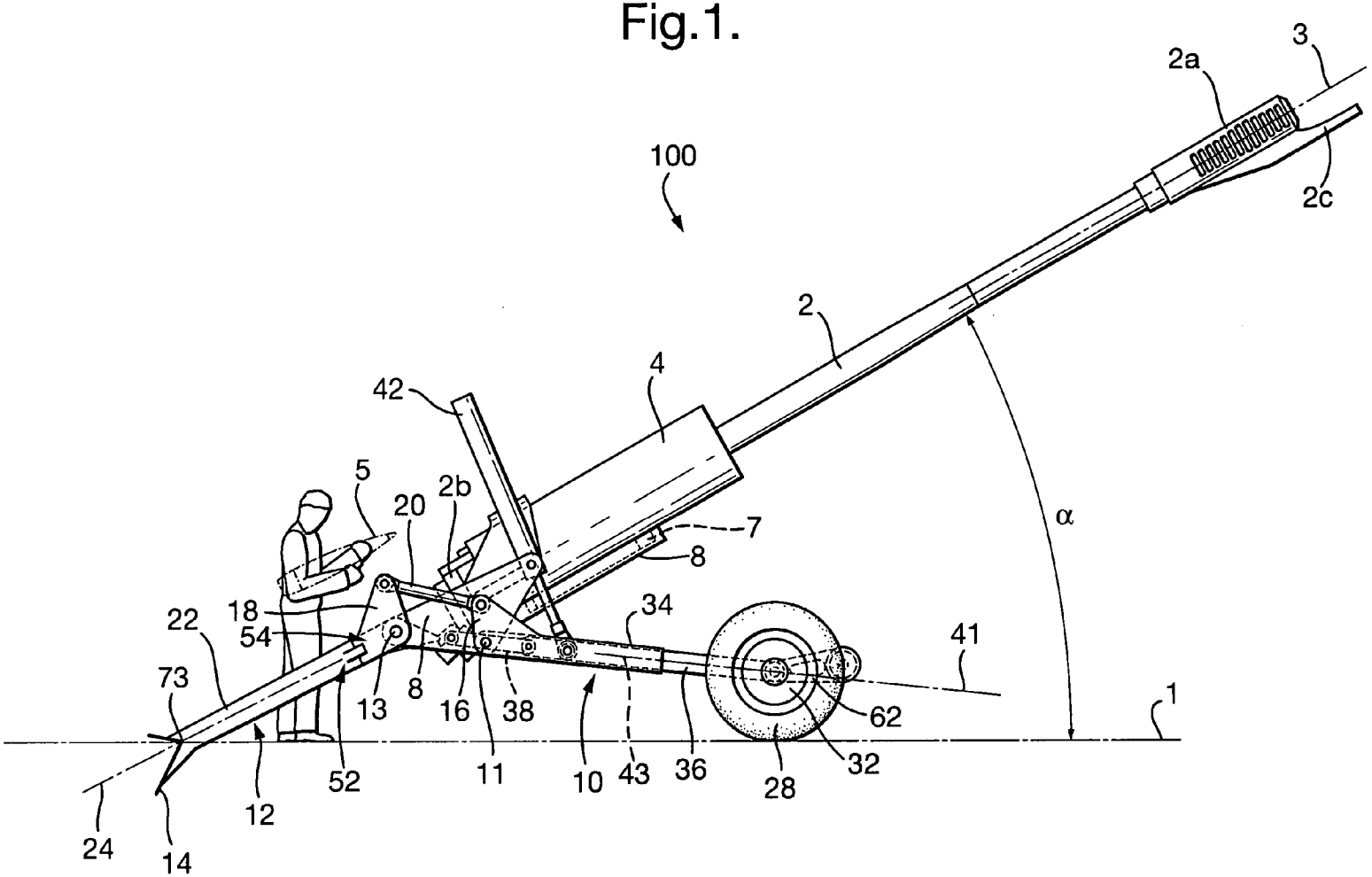
FIGS. 1 and 1A show a side elevation of an exemplary howitzer resting on a ground plane, the howitzer being in the firing mode.
Figure 2:
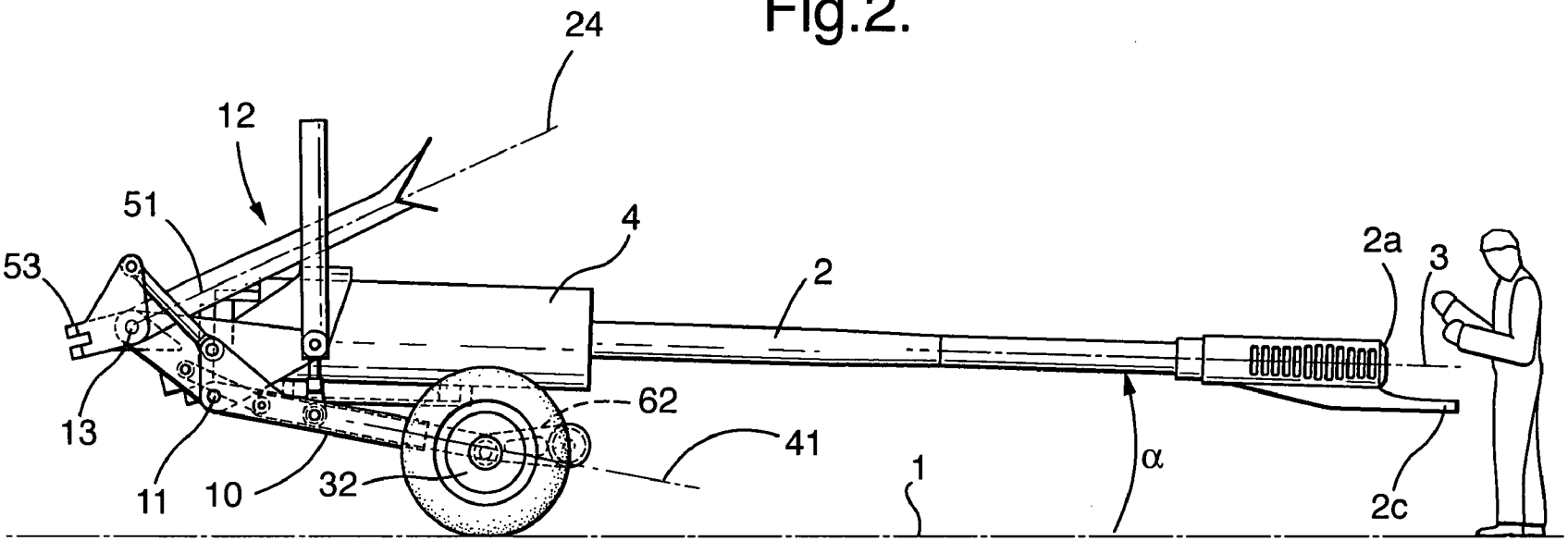
FIG. 2 shows the howitzer of FIG. 1 arranged in the travelling mode.
Figure 3:
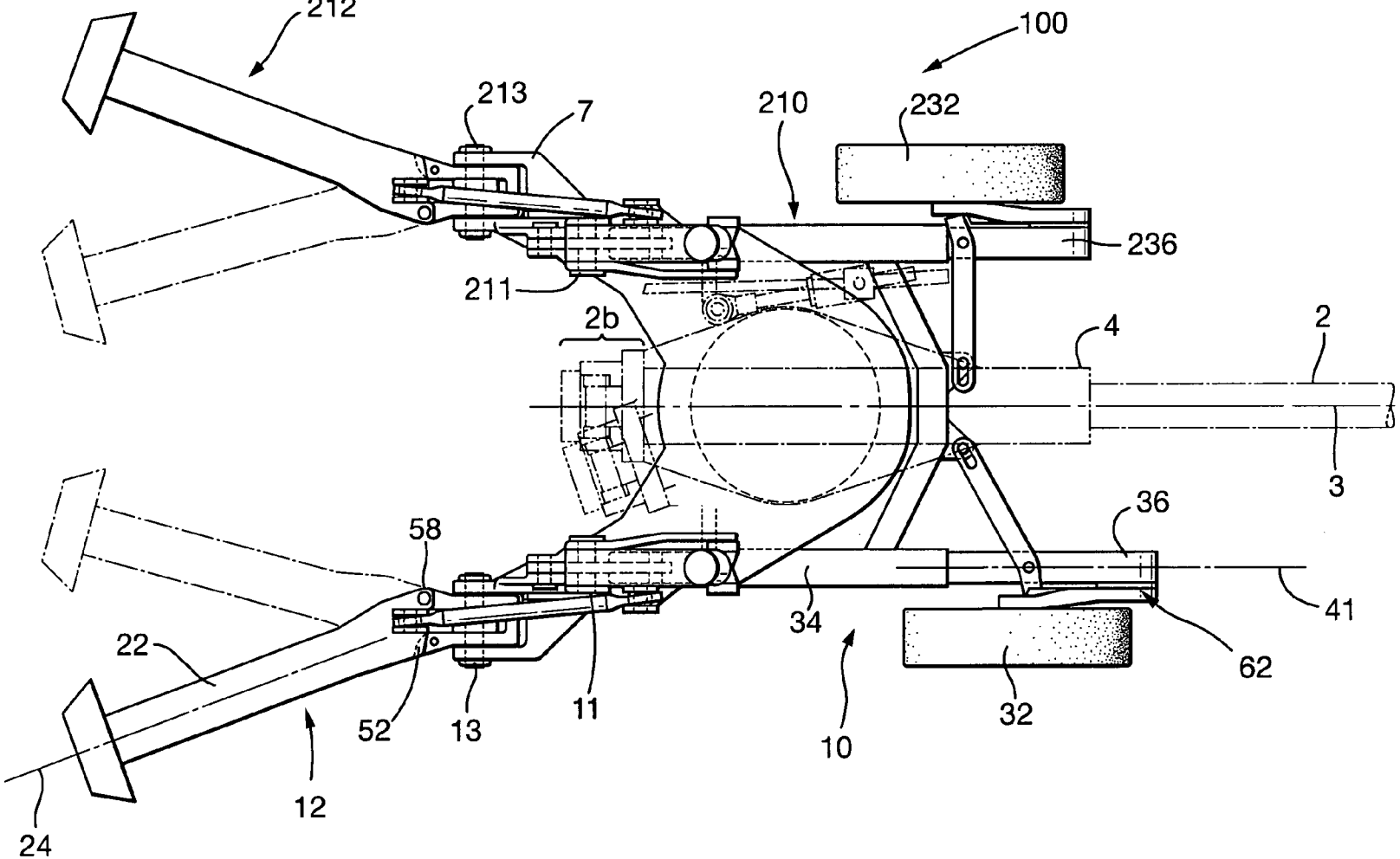
FIG. 3 shows a top-down view of the howitzer of FIG. 1 with, for the purposes of illustration, one wheel arranged for travelling, and the other arranged for firing.

Referring particularly to FIGS. 1, 2 and 3, the howitzer indicated generally at 100 is to be described. A gun barrel 2 is shown that defines a barrel axis 3. Barrel 2 has a muzzle end 2*a* and a breech end 2*b*. A muzzle lug 2*c* extends from the barrel 2 at the muzzle end 2*a*. The barrel 2 is inclined to a ground plane 1 by a certain elevation a and is inclined to the plane of the paper at a certain azimuth. In FIG. 1, the certain elevation is approximately 35° and the certain azimuth is zero. In FIG. 2, the certain elevation is approximately zero and the certain azimuth is zero. In FIG. 3, the certain azimuth is zero.

The barrel 2 is held in position by a cradle 4 which surrounds the axis of the barrel 2 in the region of the breech end 2*b*. The cradle 4 is provided with a recoil mechanism (not shown) so that when a projectile 5 (e.g. a 155 mm caliber round) is fired, the barrel 2 can move backwards through the cradle 4 along the barrel axis 3, with the recoil mechanism also reacting against the ejection of the projectile 5.

The cradle 4 is connected to an aiming means 7 for varying the elevation and the azimuth of the barrel 3.

Figure 4:
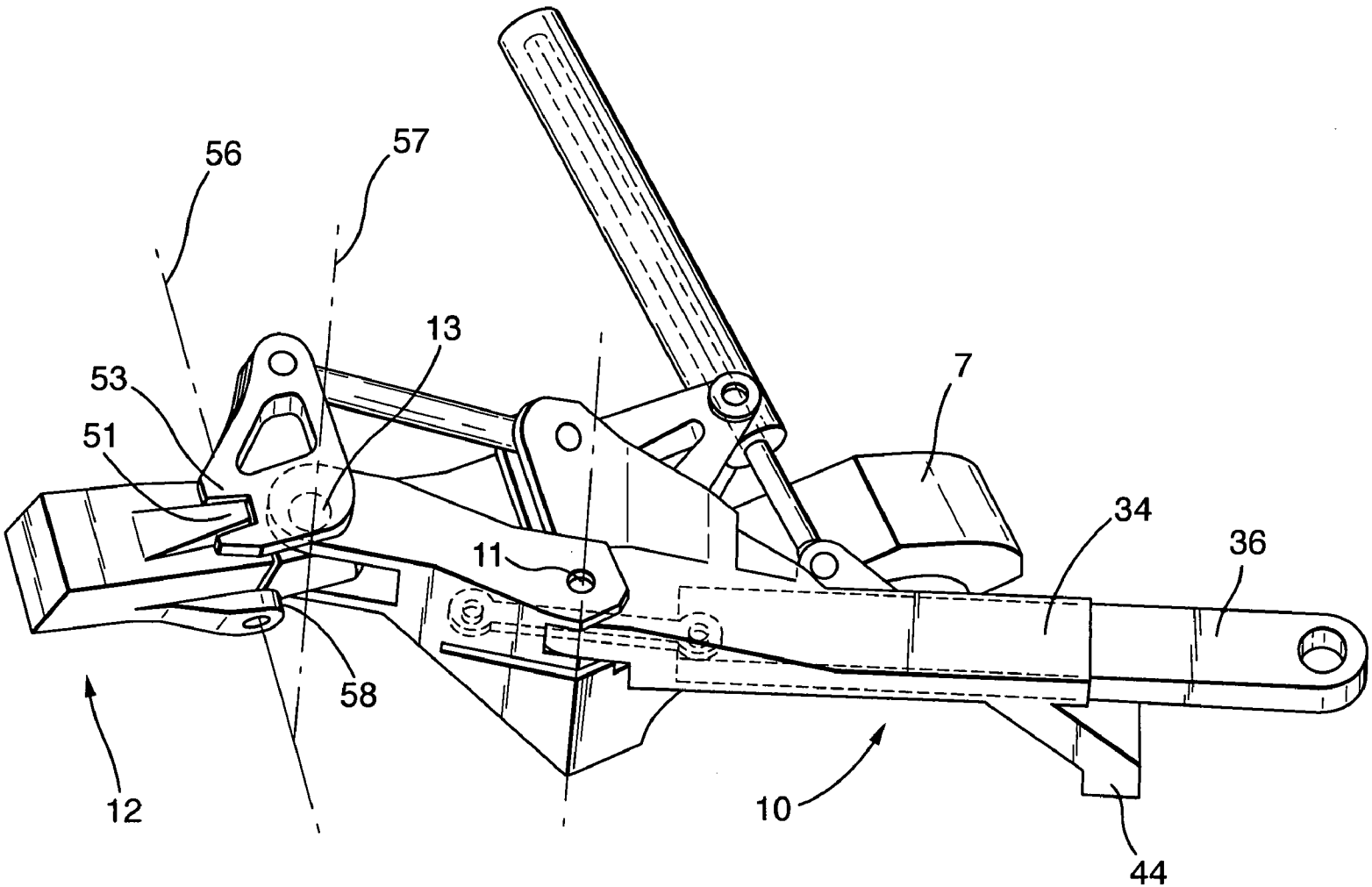
FIG. 4 shows a geometric view of a wireframe representation of the hinging between the back leg and the aiming mechanism.
Figure 5:
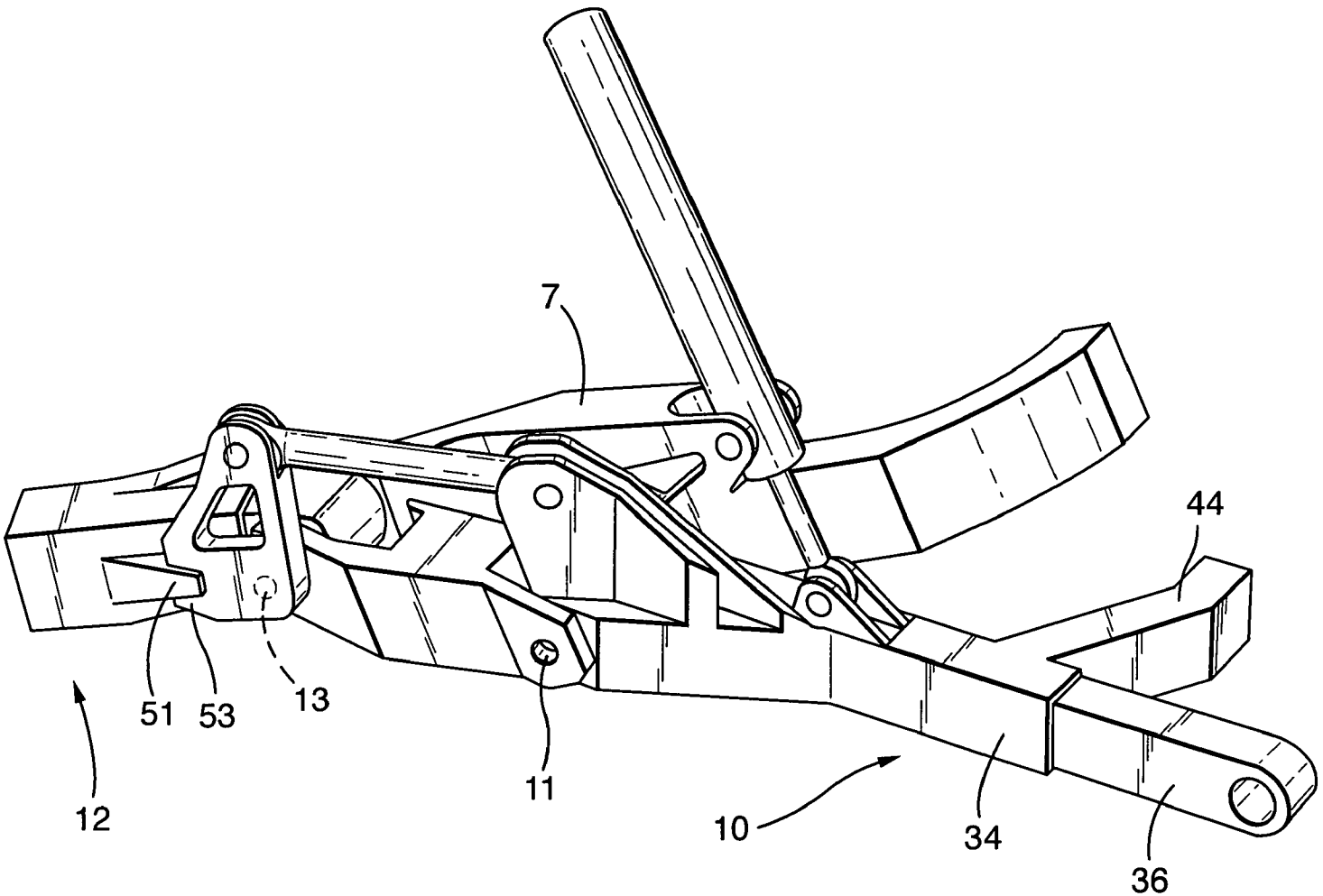
FIG. 5 shows another geometric view of the hinging and aiming mechanism such that the mortise and tenon may be clearly seen.

Referring additionally to FIGS. 4 and 5, aiming means 7 is connected to a component of front leg 10 by a first pivotable joint 11 and is connected to a back leg 12 by a second pivotable joint 13. On the opposite side of the howitzer 100 to that shown in FIGS. 1 and 2 is a second front leg 210 connected to the pivot body 8 by another pivotable joint 211, and a second back leg 212 connected to the pivot body 8 by yet another pivotable joint 213.

Front leg 10 defines a front leg axis 41 and comprises a sleeve 34 arranged coaxially along the front leg axis 41 with a sliding arm 36. The sleeve 34 and the sliding arm 36 are slidably connected; a portion of the sliding arm 36 is within the sleeve 34. The sleeve 34 is the component of the front leg 10 that is connected to the first pivotable joint 11. The sleeve 34 of the front leg 10 is connected to the sleeve of the opposite front leg 210 by brace 44 so as to form an H-shaped stanchion. The sliding arm 36 is connected at its front end to a wheel 32. The wheel 32 rests on the ground 1 at the front contact point 28. The wheel 32 has a suspension mechanism 62.

Suspension mechanism 62 can be locked by suspension restraining means 72.

Figure 6:
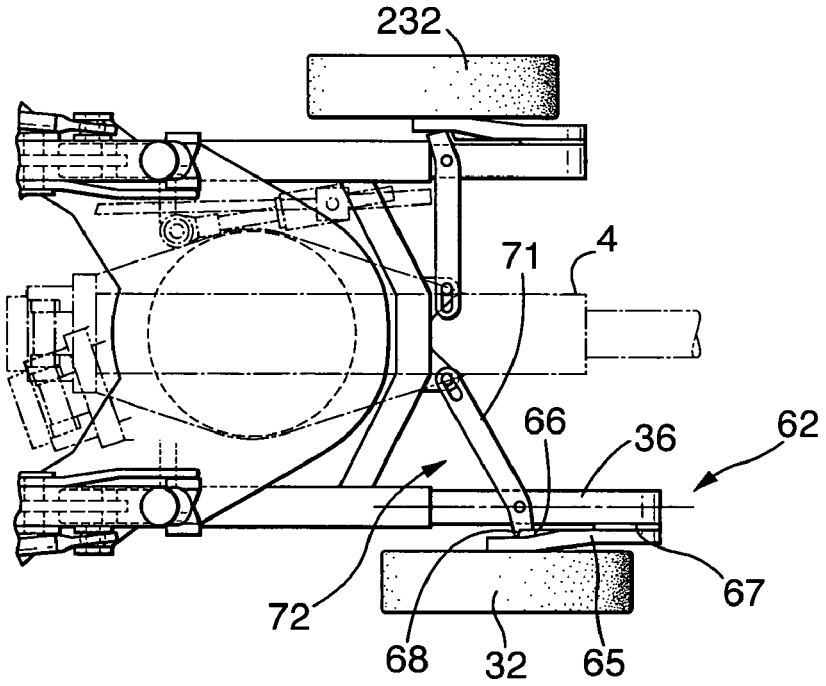
FIG. 6 shows the suspension locking mechanism of the Howitzer of FIG. 1 from a top down view.
Figure 7:
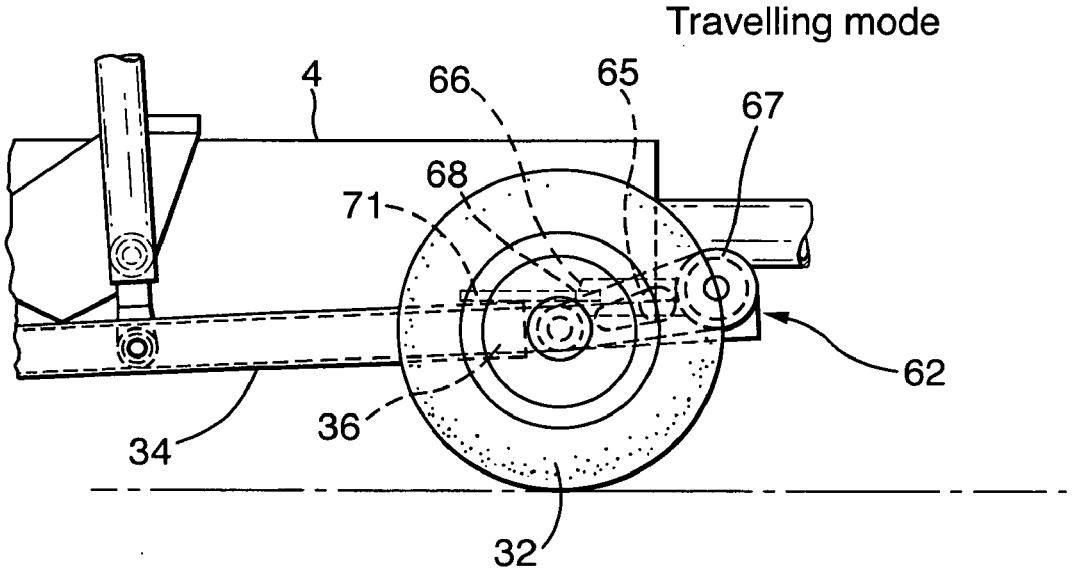
FIG. 7 shows the suspension locking mechanism of the Howitzer of FIG. 1 from a side view.

Referring to FIGS. 6 and 7, the wheel 32 is mounted at one end of a wheel arm 65 so that wheel 32 may spin freely. The opposite end of wheel arm 65 is connected to the sliding arm 36 by means of a resilient interface 67. The resilient interface 67 allows the wheel arm 65 to rotate about the resilient interface 67 but is biased to return the wheel arm 65 to an equilibrium position. This effects the suspension when the howitzer is in travelling mode.

The wheel arm 65 comprises a recess 66 for accommodating a tongue 68. The tongue 68 extends from the suspension restraining means 72. The suspension restraining means 72 is in the form of a bar 71 which is pivotally mounted to the extendable sliding arm 36 and the brace 44 so that when the sliding arm 36 is retracted, the tongue 68 does not engage the recess 66 but when the sliding arm 36 is sufficiently extended, the tongue 68 does engage the recess 66. When the tongue 68 is accommodated within the recess 66, the wheel arm 65 is restrained from rotating about the resilient interface 67.

The recess 66 and tongue 68 are tapered so that the tongue 68 may enter the recess 66 over the range of equilibrium positions.

Figure 1A:
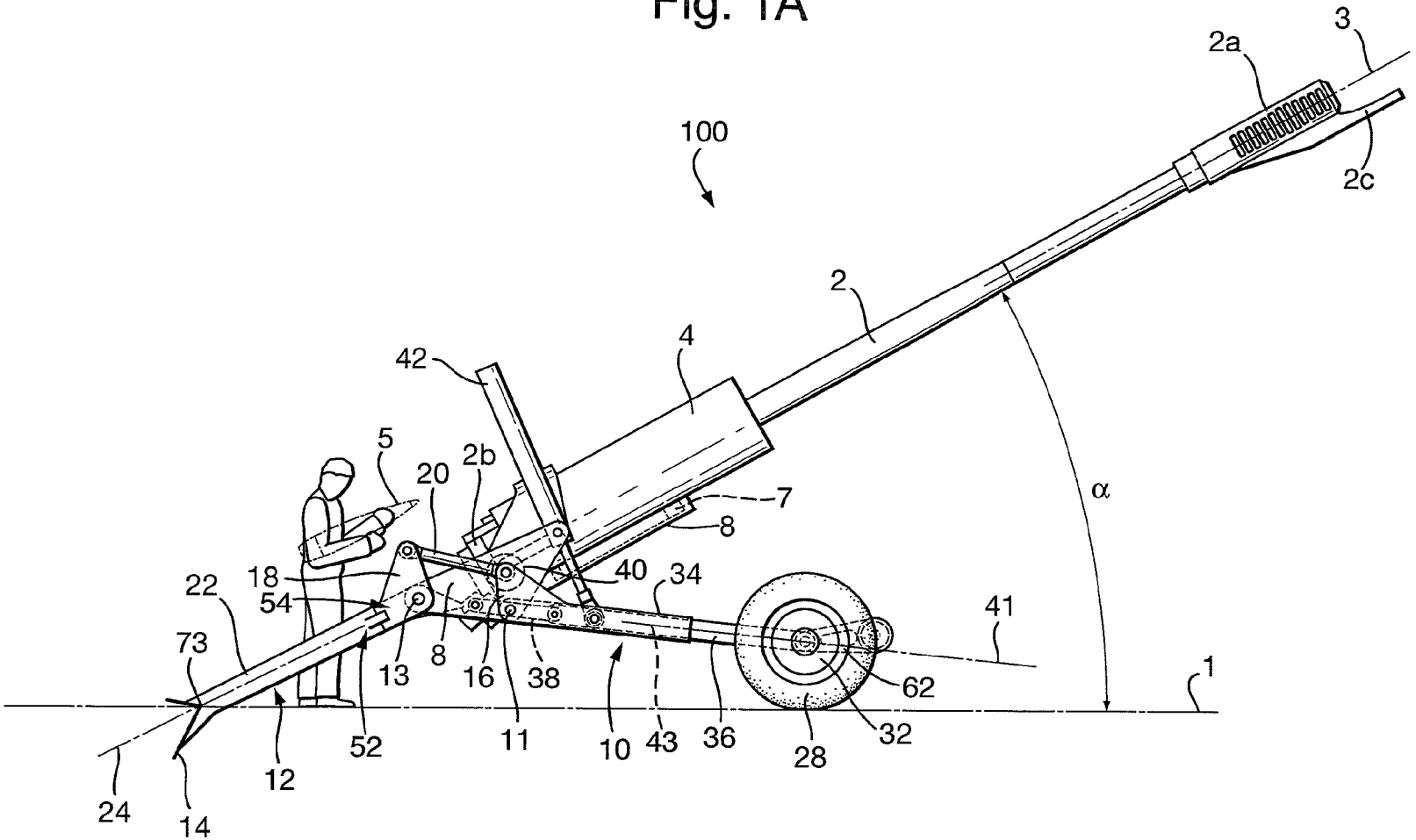

A manual drive 40 as shown in FIG. 1A is connected by a gearing to a screw drive 43 in the front leg 10 for extending and retracting the sliding arm 36.

The back leg 12 comprises an elongate member 22 that extends downwards and backwards from the second pivotable joint 13 to a surface for contacting the ground 14 (such as a spade). The back leg 12 thereby rests on the ground 1 at a backmost ground contact point 73. The elongate member 22 defines a back leg axis 24.

The back leg 12 further comprises a hinging, indicated generally in FIG. 1 at 54. Hinging 54 comprises the second pivot joint 13. The second pivot joint 13 allows the back leg 12 to rotate around the aiming means 7. Hinging 54 also comprises a hinge joint 58 which defines a hinge axis 56. The hinge joint 58 determines the splay of the back leg 12, the splay is the inclination of the back leg axis 24 to the azimuth centerline (the azimuth centerline is coaxial with barrel axis 3 in FIG. 3). The hinge axis 56 is generally perpendicular to both the back leg axis 24 and a pivot axis 57 defined by the second pivotable joint 13. The hinge axis 56 is offset from the center of elongate member 22 towards the azimuth centerline.

An interlocking mechanism, generally indicated at 52 in FIG. 1 is provided at an interface of the back leg 12 and the aiming means 7. As clearly shown in FIGS. 3 and 4, interlocking mechanism 52 comprises a tenon 51 and a mortise 53. The tenon 51 is located on the back leg 12 at generally the same point on the back leg axis 24 to the hinge 58 but offset to the opposite side (i.e. away from the azimuth centerline). The mortise 53 extends generally backwards from the aiming means 7. The mortise 53 and tenon 51 fully interlock when the back leg 12 is fully splayed out from the azimuth centerline. Once fully interlocked, the mortise 53 and the tenon 51 can be further secured by passing a bolt (not shown) through both the mortise 53 and the tenon 51. With the bolt in place, the back leg 12 cannot swing about the hinge 58.

Howitzer 100 is able to be converted from the travelling mode shown in FIG. 2 to the firing mode shown in FIG. 1.

In the travelling mode, the sliding arm 36 is in a retracted state so that the tongue 68 and the recess 66 are disengaged, the suspension mechanism 62 is thus applied. Also in travelling mode, the back leg 12 rests over the cradle 4. In the travelling mode the muzzle lug 2*c* of the howitzer 100 may be attached to a pintle of a towing vehicle (not shown).

To convert the howitzer 100 from a travelling mode to a firing mode, the front leg 10 should be extended so as to move the foremost ground contact point 28 forwards to improve the resistance to tipping and to engage the tongue 68 within recess 66; this restrains the suspension 62 to give a stable firing base. The front leg 10 is extended by way of the drive 40 which is geared to a screw drive 43 within the front leg 10.

Also, the back leg 12 should be rotated about the second pivot joint so that it may rest on the ground. The back leg 12 should also be splayed out by moving it away from the azimuth centerline by swinging it about its hinge 58. Once fully splayed, the mortise 53 and tenon 51 are engaged and can be further secured with a bolt as required. When fully deployed, the surface 14 of the back leg 12 rests on the backmost ground contact point 73.

Once the back leg 12 is deployed, the howitzer 100 can be disconnected from the towing vehicle by detaching the muzzle lug 2*c* from the pintle.

The back leg 12 should be securely attached to the ground 1. The ground contacting portions of the back leg 12 are therefore dug into the ground by some combination of the towing vehicle, the operating crew, and by the recoil force as the first round 5 of the howitzer 100 is fired.

Figure 8:
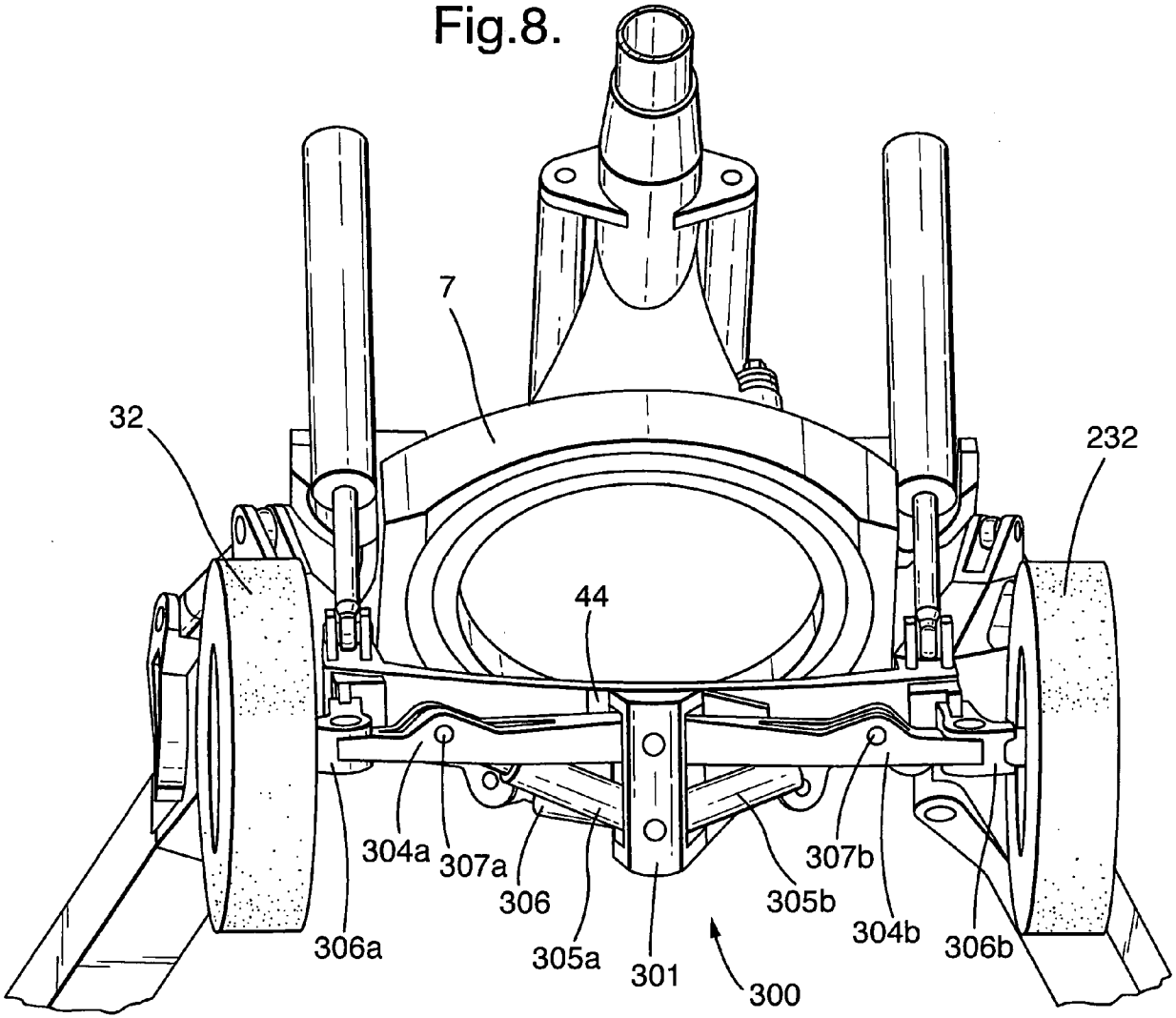
FIG. 8 shows a geometric and generally head-on view of a further howitzer having a wheel axle means arranged for contact with flat ground.
Figure 9:
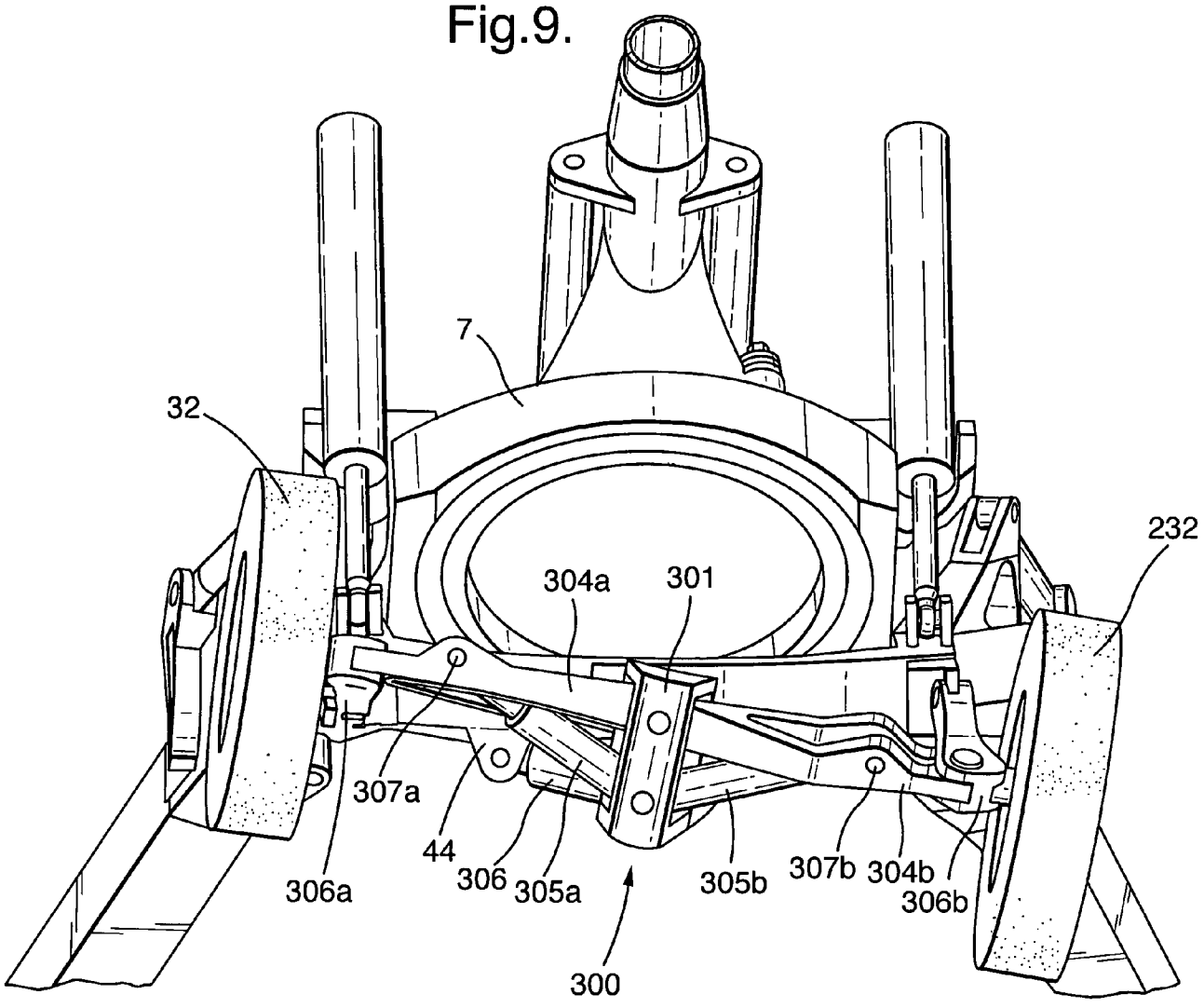
FIG. 9 shows a geometric and generally head-on view of the howitzer of FIG. 8 arranged for contact with sloped ground.
Figure 10:
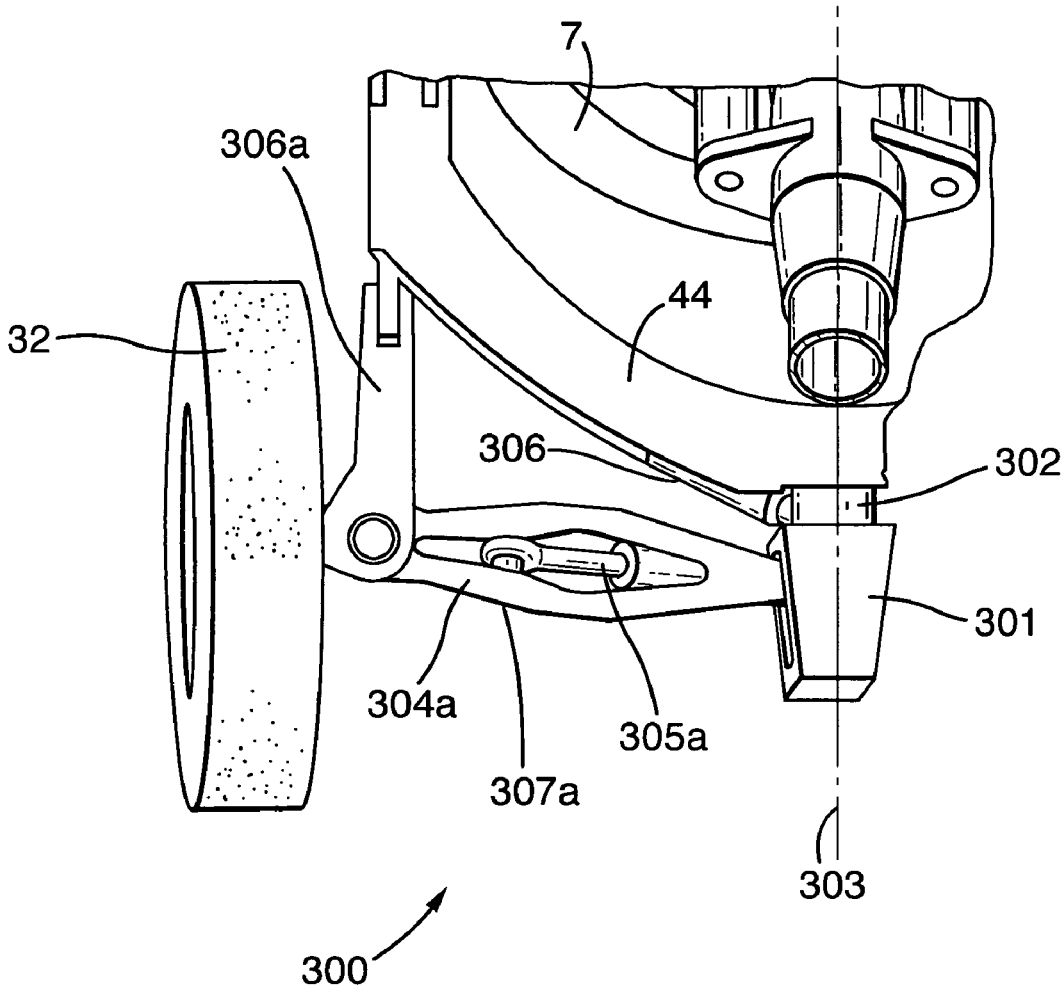
FIG. 10 shows a geometric and generally top-down view of a section of the howitzer of FIG. 8.

The howitzers 100 can alternatively be provided with a rocking mechanism 300, as shown in FIGS. 8, 9 and 10. The rocking mechanism 300 can incorporate a selectively applicable wheel suspension. The rocking mechanism 300 acts as a pivoting wheel axle.

The rocking mechanism 300 comprises a central housing 301 that is rotatably mounted on a pivot axle 302 extending from the brace 44 so that housing 301 can rotate about a pivot axle axis 303. Pivot axle axis 303 is generally perpendicular to the tangent to the arc of the brace 44. The pivot axle 302 extends from the center of the brace 44. Extending laterally from the central housing 301 are two generally coaxial wishbone suspension arms 304*a* and 304*b*. A first wishbone arm 304*a* extends to nearside wheel 32 and a second wishbone arm 304*b* extends to farside wheel 232.

Each wishbone arm 304*a* and 304*b* has an elongate form and so defines a wishbone arm axis (not shown). Each wishbone arm 304*a*, 304*b* is connected to the housing 301 by a joint (not shown) allowing each arm to rotate about its respective wishbone arm axis to a limited extent as well as to pivot up and down from the joint to a limited extent. The wishbone arms 304*a* and 304*b* tend to rotate with the housing 301 and maintain their coaxial configuration. Dampers 305*a* and 305*b* extend between the base of the housing 301, and a respective mid-point on the wishbone 307*a*, 307*b*. Each damper 305*a* and 305*b* connects to the housing 301 and the respective midpoint 307*a,b* by way of joints which enable some degree of rotation around a damper axis in addition to flapwise movement.

A rocking enabling piston 306 is connected between the housing 301 and the aiming means 7. The configuration of the piston 306 determines whether the housing 301 is free to rotate about the brace 44. When the piston 306 is locked off, the housing 301 cannot rotate. When the piston 306 is free to extend and contract, the housing 301 can rotate.

The end of each wishbone arm distal to the housing 301 is pivotally connected to a wrist 306*a*, 306*b* which extends from arm 36, 236. The wrists 306*a*, 306*b* are pivotally connected to arms 36, 236. Wheels 32, 232 spin off a bearing (not shown) mounted on wrist 306*a*, 306*b*.

The rocking mechanism 300 can be activated by unlocking the piston 306 so that the housing 301 is able to rotate about the pivot axle axis 303. The wheel axle (defined by the generally coaxial wishbone arms 304*a* and 334*b*) is then free to rotate about the pivot axle axis 303 so that if the howitzer is not placed on perfectly flat ground, each wheel can contact the ground to support the gun and bear the firing forces.

In use, once the piston 306 is unlocked, the housing 301 automatically rotates under the weight of the howitzer 100 so that both wheels 32 and 232 contact the ground. Once both wheels 32 and 232 are contacting the ground, the dampers 305*a* and 305*b* should be secured so as not to affect firing. This can be done by locking the dampers 305*a* and 305*b* in place prior to firing, or alternatively by having dampers that automatically lock off under short duration forces (as encountered during firing) but allow movement under long duration forces (such as the weight of the howitzer 100) and medium duration forces (such as encountered when the dampers and piston act as a selectively applicable wheel suspension system).

The components of the howitzer are fabricated from materials which are able to withstand the peak stresses and the cyclic loads that will be experienced in operation. In relation to this, the form of the components will be chosen according to the same criteria. The materials and forms will be chosen to minimise weight without compromising the strength. Given this, various steel alloys, composites and titanium may, for example, be suitable materials. The man skilled in the art of howitzer design would be able to decide which materials and forms would be best in the circumstances.

Whilst the example described above relates specifically to a 155 mm caliber round, the invention is in no way limited to any particular caliber. For example, a howitzer according to this invention could be for firing 105 mm rounds.

Further, it is envisaged that howitzers within the scope of the claims of the present invention may be constructed so as to be apt for disassembly and re-assembly. Such an aptitude would enable the howitzer to be transported by an even wider range of transport vehicles and further, would allow for worn out parts to be place individually without taking the entire howitzer out of service.

Further variants within the scope of the invention would be obvious to the skilled man.

The invention claimed is:

1. A towed howitzer, interchangeable between a travelling mode and a firing mode, the towed howitzer being suitable for deployment on a ground plane, the towed howitzer comprising:

a barrel for firing a projectile, the barrel defining a barrel axis;

a cradle for holding the barrel at an azimuth and an elevation;

an aiming mechanism capable of varying the elevation and the azimuth of the barrel;

a front leg, for supporting the aiming mechanism, comprising a wheel intended for contacting the ground at a foremost ground contact point and a sliding mechanism for extending and retracting the wheel along a longitudinal front leg axis;

a suspension system for resiliently mounting the wheel a restraining mechanism for selectively enabling the suspension system; and a back leg for contacting the ground at a backmost ground contact point, the back leg comprising a hinging for swinging the back leg out of contact with the ground, wherein in the firing mode, the suspension system is locked and the back leg contacts the ground at the backmost contact point, and in the travelling mode, the back leg is lifted off the backmost contact point and the suspension system is applied.

2. A towed howitzer according to claim 1 wherein the hinging articulates the back leg such that the back leg can rest over the cradle.

3. A towed howitzer according to claim 1, wherein the hinging comprises a first hinge defining a first hinge axis, and a second hinge defining a second hinge axis wherein the first hinge axis and the second hinge axis are generally perpendicular.

4. A towed howitzer according to claim 3, wherein the back leg has an elongate form defining a back leg axis, the first hinge axis is offset from the back leg axis towards a centerline defined by the howitzer, the first hinge thereby determining the inclination of the back leg to the centerline.

5. A towed howitzer according to claim 4 wherein the aiming means comprises a mortise and the back leg comprises a tenon, the tenon being situated generally at the same point on the back leg axis as the first hinge and being laterally offset from the back leg axis away from the centerline of the howitzer such that when the back leg is at a maximum inclination to the centerline, the tenon engages the mortise to secure the back leg.

6. A towed howitzer according to claim 1 wherein the barrel comprises a muzzle, the muzzle having a lug for forming an attachment to a towing pintle.

7. A towed howitzer according to claim 1 wherein the suspension system comprises:

a wheel arm, connecting the wheel to the rest of the front leg, and pivotable about a resilient mount;

a recess within the wheel arm; and wherein the restraining mechanism comprises a tongue for engaging the recess so as to inhibit pivoting of the wheel arm about the resilient mount.

8. A towed howitzer according to claim 7 wherein the wheel arm is resiliently mounted on a sliding arm such that when the sliding arm is extended, the tongue engages the recess and such that when the sliding arm is retracted the tongue is disengaged from the recess.

9. A method of converting a towed howitzer from a travelling position to a firing position, the towed howitzer comprising:

a barrel for firing a projectile, the barrel defining a barrel axis;

a cradle for holding the barrel at an azimuth and an elevation;

an aiming mechanism capable of varying the elevation and the azimuth of the barrel;

a front leg for supporting the aiming mechanism comprising a wheel intended for contacting the ground at a foremost ground contact point and a sliding mechanism for extending and retracting the wheel along a longitudinal front leg axis;

a suspension system for resiliently mounting the wheel; and a suspension restraining mechanism;

a back leg for contacting the ground at a backmost ground contact point, the back leg comprising a hinging for swinging the back leg out of contact with the ground, wherein the method comprises the steps of:

extending the wheel to the foremost ground contact point;

swinging the back leg about the hinging so as to move the back leg from a resting position over the cradle to a position where the back leg contacts the ground at the backmost contact point; and applying the suspension restraining mechanism.

* * * * *

UNITED STATES PATENT AND TRADEMARK OFFICE

CERTIFICATE OF CORRECTION

PATENT NO. : 8,020,484 B2
APPLICATION NO. : 12/291027
DATED : September 20, 2011
INVENTOR(S) : David Andrew Eaglestone It is certified that error appears in the above-identified patent and that said Letters Patent is hereby corrected as shown below:

Title Pg, Item (75) Inventor: should read

-- (75) Inventor: David Andrew Eaglestone --.

Signed and Sealed this
Twenty-second Day of November, 2011

David J. Kappos

David J. Kappos
*Director of the United States Patent and Trademark Office*